US006556801B1

(12) United States Patent
Shimaoka et al.

(10) Patent No.: US 6,556,801 B1
(45) Date of Patent: Apr. 29, 2003

(54) IMAGE DEVELOPING UNIT CAPABLE OF EASILY AND SECURELY DISPERSING TONER, AND IMAGE FORMING APPARATUS

(75) Inventors: Takashi Shimaoka, Shizuoka-ken (JP); Atsushi Suzuki, Shizuoka-ken (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/981,249

(22) Filed: Oct. 16, 2001

(51) Int. Cl.[7] ..... G03G 15/08
(52) U.S. Cl. ..... 399/258
(58) Field of Search ..... 399/258, 260

(56) References Cited

U.S. PATENT DOCUMENTS

| | | | | |
|---|---|---|---|---|
| 3,985,098 A | * | 10/1976 | Myers et al. | 399/258 |
| 4,442,789 A | * | 4/1984 | Pirwitz | 399/258 X |
| 4,558,659 A | * | 12/1985 | Alden | 399/258 X |
| 5,053,825 A | * | 10/1991 | Trainor et al. | 399/260 |
| 5,722,002 A | * | 2/1998 | Kikuta et al. | 399/258 X |
| 5,734,952 A | * | 3/1998 | Murakami et al. | 399/258 X |

FOREIGN PATENT DOCUMENTS

| | | | |
|---|---|---|---|
| JP | 6-19314 A | | 1/1994 |
| JP | 7-175312 | * | 7/1995 |
| JP | 9-288410 | * | 11/1997 |
| JP | 10-198165 A | | 7/1998 |
| JP | 10-247011 | * | 9/1998 |

* cited by examiner

*Primary Examiner*—Fred L. Braun
(74) *Attorney, Agent, or Firm*—Frishauf, Holtz, Goodman & Chick, P.C.

(57) ABSTRACT

An image developing unit is provided which includes a toner cartridge and an image developing device. The image developing device includes a toner tank having a toner inlet capable of receiving a toner flowed out from a toner outlet of the toner cartridge and a toner supply route extending away from the toner inlet. A conveyor is provided for transporting away from the toner inlet the toner received by the toner supply route, and an image developing roller is set in the toner tank. The toner supply route has a plurality of toner supply ports arranged away from the toner inlet, and respective aperture areas of the toner supply ports gradually increase with distance from the toner inlet.

8 Claims, 4 Drawing Sheets

IMAGE DEVELOPING UNIT CAPABLE OF EASILY AND SECURELY DISPERSING TONER, AND IMAGE FORMING APPARATUS

BACKGROUND OF THE INVENTION

The present invention relates to an image developing unit used for electrophotography and an image forming apparatus provided with the image developing unit.

An image forming apparatus that adopts electrophotography has a photosensitive device, charging device, exposing device, image developing device, transferring device, and fixing device set in its apparatus body, in order to record an image on a recording sheet. The charging device charges the photosensitive device. The exposing device forms a latent image by exposing the photosensitive device. The image developing device forms a toner image by applying a toner to the photosensitive device to develop the latent image. The transferring device transfers the toner image on the photosensitive device to the recording sheet. The fixing device fixes the toner image on the recording sheet.

In this image forming apparatus, an image developing unit comprises the image developing device and a toner cartridge. The image developing device has a toner tank that stores a toner and a photosensitive device for supplying and applying the toner in the toner tank to the photosensitive device. The toner cartridge is stored with the toner. The toner is delivered from the toner cartridge and fed into the toner tank of the image developing device. To attain this, the toner tank of the image developing device is provided with supply means for feeding the toner delivered from the toner cartridge into the toner tank.

The toner tank includes a toner inlet that receives the toner supplied from the toner cartridge. The supply means includes a toner supply route that extends away from the toner inlet and receives the toner having passed through the toner inlet and conveyor means for transporting away from the toner inlet the toner received by the toner supply route. The toner supply route has a single toner supply port in the central portion with respect to its lengthwise direction (away from the toner inlet). This toner supply port makes the toner, transported through the toner supply route by means of the conveyor means, flow into the toner tank.

In the toner tank, an image developing roller is set extending parallel to the toner supply route, and an agitator is set between the toner supply route and the image developing roller so as to extend parallel to the toner supply route. The toner which flows out from the toner supply port of the toner supply route is transported to the image developing roller, and is agitated by rotation of the agitator.

In this conventional image developing unit, the toner is supplied from the toner supply port that is located in one position on the toner supply route to one place in the toner tank. The toner in the one place is dispersed covering the entire image developing roller in its axial direction and supplied to the image developing roller by rotation of the agitator. Thus, the dispersion of the toner, covering the entire image developing roller in its axial direction, depends on the agitator alone.

However, the dispersion of the toner in the one position by means of the agitator alone, covering the entire image developing roller in its axial direction, is limited, and the toner is transported to the image developing roller before it is fully agitated by means of the agitator and uniformly dispersed covering the entire image developing roller in its axial direction. Thus, the toner is supplied to the image developing roller in a manner such that it is concentrated on the one place in the axial direction of the image developing roller that corresponds to the toner supply port of the toner supply route. In other words, the toner is locally supplied to one portion of the image developing roller. In consequence, the image developing roller forms the toner image to supply the toner to the photosensitive drum locally, so that the image quality is lowered.

BRIEF SUMMARY OF THE INVENTION

The object of this invention is to provide an image developing unit which is capable of easily and securely dispersing a toner delivered from a toner cartridge to cover an entire area of an image developing roller of an image developing device in its axial direction, thereby ensuring satisfactory image quality, and it is also an object of this invention to provide an image forming apparatus provided with such an image developing unit.

According to the invention an image developing unit is provided which comprises a toner cartridge and an image developing device wherein, the toner cartridge stores a toner and has a toner outlet through which the toner flows out, and the image developing device includes a toner tank having a toner inlet capable of receiving the toner flowed out from the toner outlet of the toner cartridge and a toner supply route extending away from the toner inlet and capable of receiving the toner flowed into through the toner inlet. A conveyor means is provided for transporting away from the toner inlet the toner received by the toner supply route, and an image developing roller is set in the toner tank. The toner supply route has a plurality of toner supply ports arranged away from the toner inlet so that the toner in the toner supply route flows out through the toner supply ports into the toner tank, and the respective aperture areas of the plurality of toner supply ports gradually increase with distance from the toner inlet.

According to the invention an image forming apparatus is provided which comprises an apparatus body, a photosensitive device, and an image developing unit including a toner cartridge and an image developing device. The toner cartridge stores a toner and has a toner outlet through which the toner flows out, and the image developing device includes a toner tank having a toner inlet capable of receiving the toner flowed out from the toner outlet of the toner cartridge and a toner supply route extending away from the toner inlet and capable of receiving the toner flowed into through the toner inlet. A conveyor means is provided for transporting away from the toner inlet the toner received by the toner supply route, and an image developing roller is set in the toner tank. The toner supply route has a plurality of toner supply ports arranged away from the toner inlet so that the toner in the toner supply route flows out through the toner supply ports into the toner tank, and the respective aperture areas of the plurality of toner supply ports gradually increase with distance from the toner inlet.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

An embodiment of this invention will be described with reference to the drawings.

Figure 1:
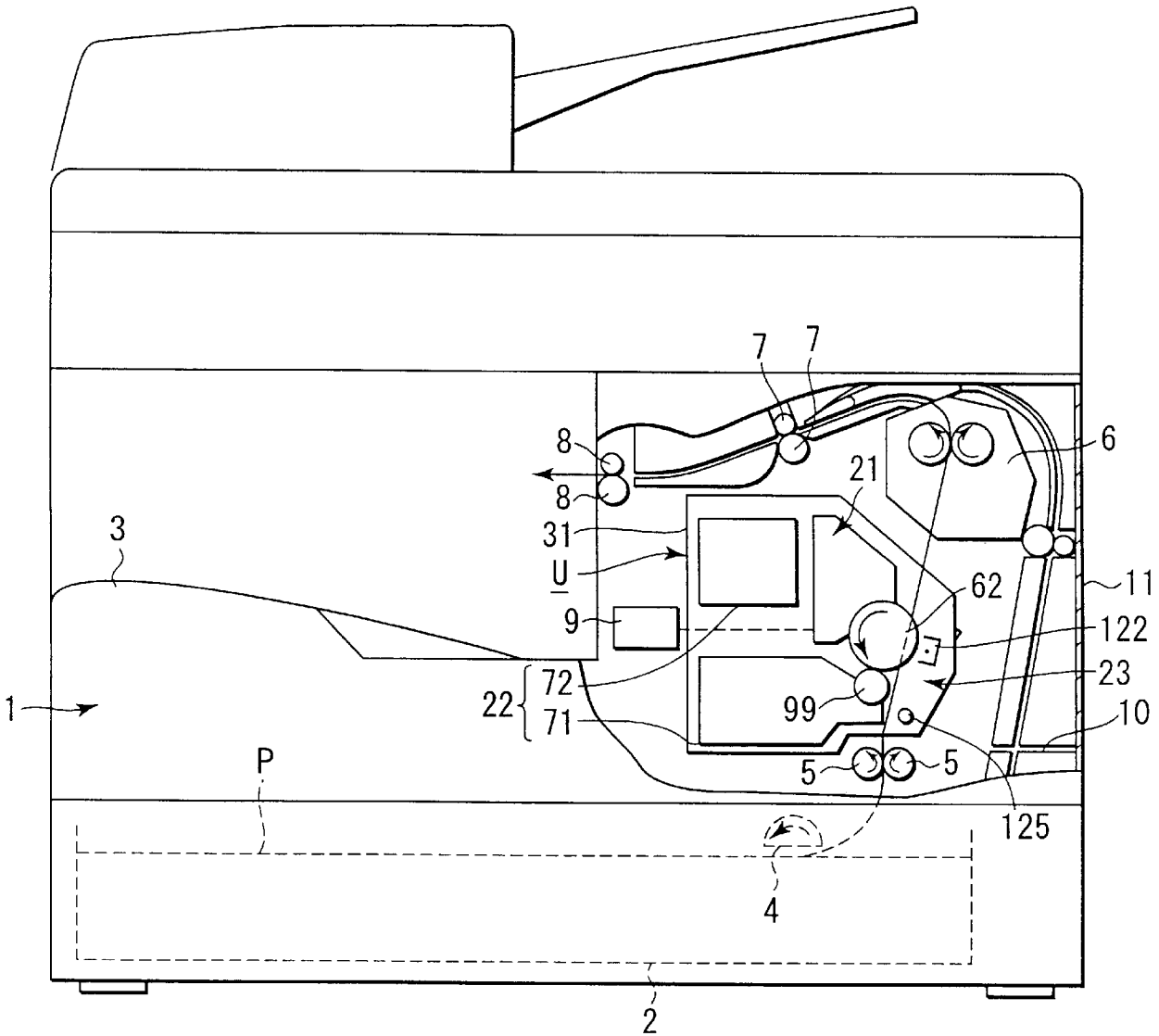
FIG. 1 is a cutaway front view showing a part of an image forming apparatus according to an embodiment of this invention in which a process unit is set.

FIG. 1 shows an image forming apparatus. A process unit U is set in the middle portion in an apparatus body 1, and a paper cassette 2 is set in the lower portion. Recording sheets P are stored in layers in the paper cassette 2. A receiving tray 3 is set in the middle portion in the apparatus body 1. In the apparatus body 1, a paper-supply roller 4 and feed rollers 5 are located below the process unit U, and a fixing device 6, feed rollers 7, and exit rollers 8 are located above the process unit U. An exposing device 9 is set in the apparatus body 1. The apparatus body 1 has an opening 10 in its lateral part that faces the process unit U, and a cover 11 that covers and uncovers the opening 10 is provided on the lateral part.

In this image forming apparatus, the paper-supply roller 4 picks up the recording sheets P one by one from the paper cassette 2 as rotating, and the feed rollers 5 transport the recording sheets P to the process unit U by rotating. The process unit U transfers a toner image as transporting the recording sheets P upward. The fixing device 6 fixes the transferred toner image on the recording sheets P as it transports the recording sheets P. The feed rollers 7 transport the recording sheets P by rotating, and the exit rollers 8 discharge the recording sheets P onto the receiving tray 3 by rotating.

Figure 2:
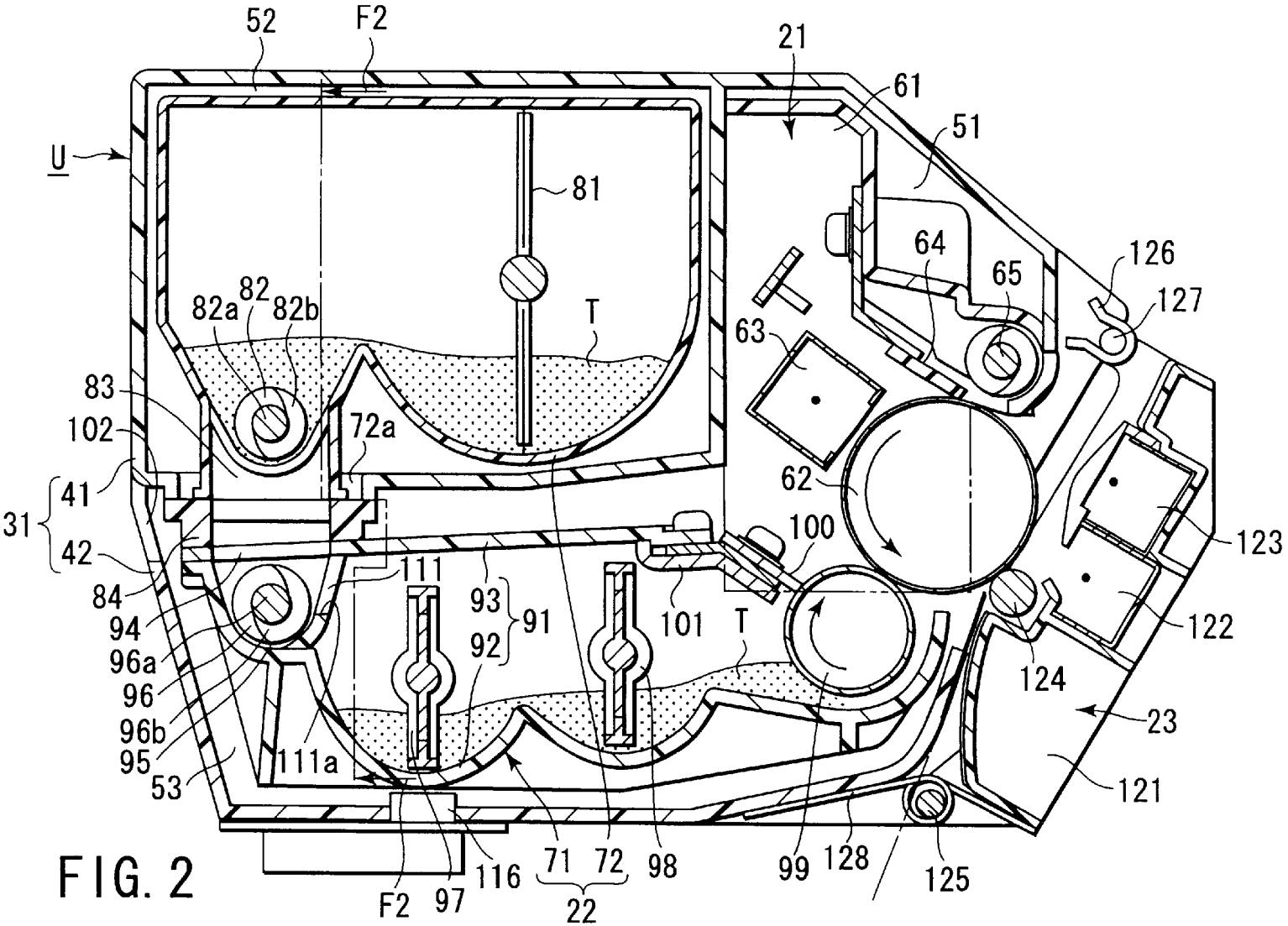
FIG. 2 is a sectional view showing the process unit provided with an image developing unit according to the same embodiment.
Figure 3:
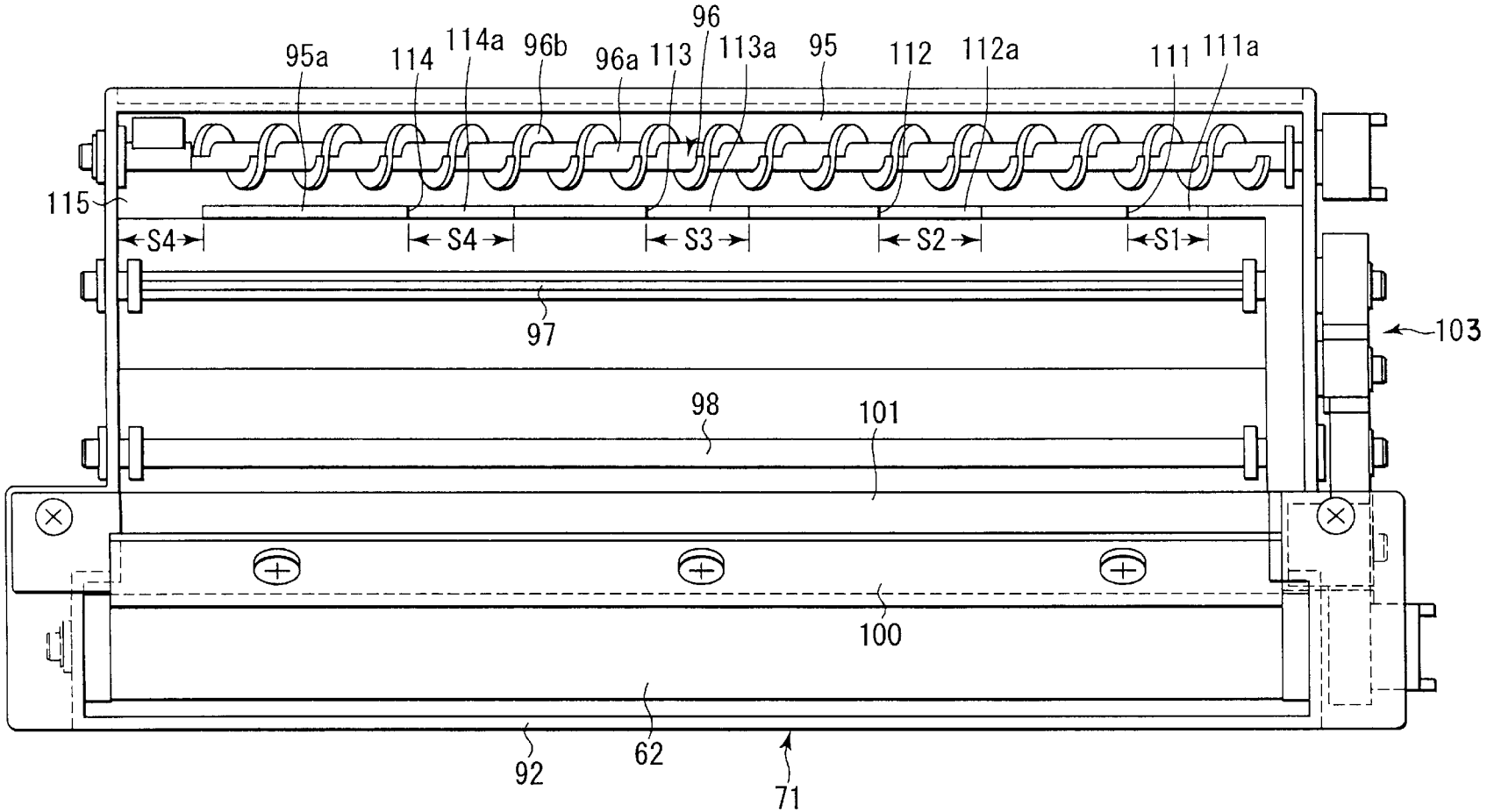
FIG. 3 is a plan view showing the image developing unit according to the same embodiment.
Figure 4:
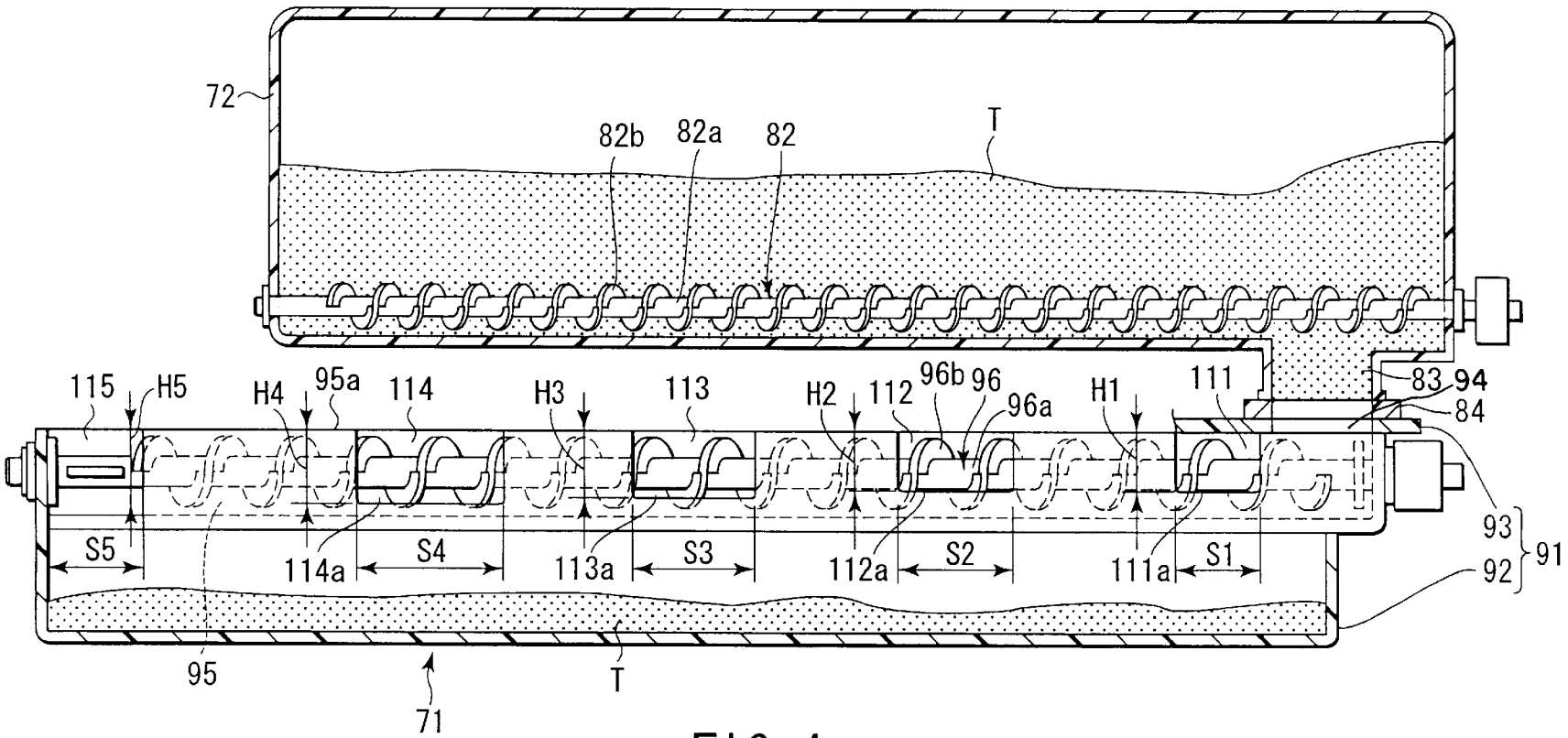
FIG. 4 is a sectional view of the image developing unit according to the same embodiment taken along line F2—F2 of FIG. 2.

The process unit U that includes an image developing unit will now be described with reference to FIGS. 2 to 4. FIG. 2 is a sectional view showing the process unit U, FIG. 3 is a plan view showing the image developing unit, and FIG. 4 is a sectional view taken along line F2—F2 of FIG. 2.

The process unit U comprises a photosensitive device unit 21, image developing unit 22, and transfer unit 23. A unit housing 31 is formed by combining an upper housing 41 and a lower housing 42, and has a space portion inside. The upper housing 41 is opened bottom face, and the lower housing 42 is opened top face. The upper housing 41 and the lower housing 42 are combined with their respective opened portions opposed to each other, and are removably coupled to each other by means of screws (not shown).

The upper housing 41 is formed in a manner such that a laterally elongate space portion 51 that contains the photosensitive device unit 21 and a laterally elongate chamber 52 that contains a toner cartridge 72 are arranged extending parallel to each other. The lower housing 42 has a laterally elongate space portion 53 that contains an image developing device 71.

The photosensitive device unit 21 includes a photosensitive device unit body 61, photosensitive drum 62 as a photosensitive device, charging device 63, cleaning blade 64, and screw 65.

The photosensitive device unit body 61 is laterally elongate. The photosensitive drum 62 is located in the photosensitive device unit body 61 so as to extend in its lengthwise direction, and is rotatably supported on the photosensitive device unit body 61. A drive mechanism (not shown) is set in the body 1 of the image forming apparatus. This drive mechanism rotates the photosensitive drum 62 in the direction of the arrow.

The charging device 63 serves to charge the surface of the photosensitive drum 62 according to a system that utilizes corona discharge, and has the same length with the photosensitive drum 62. The charging device 63 is mounted in a position above the photosensitive drum 62.

The cleaning blade 64 serves to scrape off a toner that remains on the surface of the photosensitive drum 62 after the toner image on the surface of the photosensitive drum 62 is transferred to a recording sheet. The cleaning blade 64 is located adjacent to the upper-stream side of the charging device 63 with respect to the rotating direction of the photosensitive drum 62, and is attached to the photosensitive device unit body 61.

As the screw 65 rotates, it carries out of the photosensitive device unit body 61 the residual toner that is scraped from the photosensitive drum 62 by means of the cleaning blade 64. The screw 65 is placed side by side with the cleaning blade 64 in the photosensitive device unit body 61. A sealing plate 66 serves to prevent the residual toner from leaking from the photosensitive device unit body 61.

The photosensitive device unit 21 is located in the space portion 51 of the upper housing 41, and the photosensitive device unit body 61 is detachably attached to the upper housing 41 by means of screws (not shown).

The image developing unit 22 is provided with the image developing device 71 and the toner cartridge 72. The toner cartridge 72 is detachably contained in the chamber 52 of the upper housing 41. The image developing device 71 is set in the space portion 53 of the lower housing 42. The toner cartridge 72, which stores a toner T, has a toner outlet 83 formed in one end portion of its bottom. An agitator 81 for agitating the toner T is set in the toner cartridge 72 and rotatably supported on the toner cartridge 72. In the toner cartridge 72, a conveyor screw 82 is placed extending parallel to the agitator 81 and rotatably supported on the toner cartridge 72. This conveyor screw 82 is formed of a shaft 82*a* and a helical blade 82*b* thereon. The conveyor screw 82 is set so that one end of the shaft 82*a* is situated above the toner outlet 83. Thus, the conveyor screw 82 serves to transport the toner T in the toner cartridge 72 toward the toner outlet 83. The agitator 81 and the conveyor screw 82 are rotated individually by means of drive mechanisms (not shown) in the apparatus body 1.

The chamber 52 of the upper housing 41 is in the form of a tube having one end open. The toner cartridge 72 can be inserted into the chamber 52 and drawn out through an opening of the chamber 52. The bottom of the chamber 52 has a hole portion 72*a* that make the toner outlet 83 free from the toner cartridge 72.

The image developing device 71 has a toner tank 91 that stores the toner T. The toner tank 91 is composed of a casing 92 and a cover 93. The casing 92 is opened top. The cover 93, which covers a top opening of the casing 92, is detachably attached to the casing 92 by means of screws (not shown). The cover 93 does not cover the part of the opened portion of the casing 92 which is located under the photosensitive drum 62. The cover 93 has a toner inlet 94, and the toner inlet 94 is located under the toner outlet 83 of the toner cartridge 72.

A gasket 84 is attached to the upper surface portion of the cover 93, overlaying the toner inlet 94. The gasket 84 connects to the toner outlet 83 of the toner cartridge 72 as overlaying. The toner delivered to the toner outlet 83 moves through the gasket 84 to the toner inlet 94, and is fed into the toner tank 91.

In the toner tank 91 of the casing 92, a toner supply route 95 is formed at the position where is located under the conveyor screw 82 of the toner cartridge 72. This toner supply route 95 extends in a straight line parallel to the conveyor screw 82, and is opened its upper half. Thus, the toner supply route 95 is formed by a groove that extends straight away from the toner inlet 94. The toner supply route 95 has a length corresponding to the size of the casing 92 and both end portions are closed. One end portion of the toner supply route 95 is located under the toner inlet 94 so that it can receive the toner T that is carried from the toner inlet 94. The other end portion of the toner supply route 95 is located at a distance from the toner inlet 94.

In the toner supply route 95, a conveyor screw 96 as conveyor means is set extending in the lengthwise direction of the toner supply route 95. This conveyor screw 96 is formed of a shaft 96*a* and a helical blade 96*b* thereon, the shaft 96*a* being rotatably supported on the casing 92. This conveyor screw 96 serves to transport the toner T, received by the toner supply route 95, away from the toner inlet 94. More specifically, the conveyor screw 96 transport the toner T from the one end portion of the toner supply route 95 to the other end portion by being rotated by means of a drive mechanism (not shown).

The toner supply route 95 has a plurality of toner supply ports 111, 112, 113 and 114 in its lateral part that is directed to the inner part of the casing 92. These toner supply ports 111, 112, 113 and 114, which allow the toner T in the toner supply route 95 to flow out into the toner tank 91, are formed in the lateral part of the casing 92 and arranged away from the toner inlet 94 at equal spaces. The toner supply port 111 is located nearest to the toner inlet 94, and the toner supply port 114 is located farthest from the toner inlet 94. The other end portion of the toner supply route 95 is formed a toner supply port 115 in its lateral part that is directed to the inner part of the casing 92. The other end portion of the toner supply route 95 is a terminal portion with respect to the direction of toner transportation, and all the toner T must be run out at the terminal end into the toner tank 91. Thus, the toner T is flowed out from the toner supply route 95 through the 115.

The toner supply ports 111 to 114 have their respective aperture areas gradually increased with distance from the toner inlet 94.

The following configuration is used for making the respective aperture areas of these toner supply ports 111 to 115 differ. The toner supply ports 111 to 114 have horizontal lower edges 111*a*, 112*a*, 113*a* and 114*a*, respectively, which stem the toner T in the toner supply route 95. The respective heights H1, H2, H3 and H4 of these lower edges 111*a*, 112*a*, 113*a* and 114*a* gradually increase as the toner supply ports 111 to 114 become more distant from the toner inlet 94. The heights H1, H2, H3 and H4 are the aperture heights of the toner supply ports 111 to 114, respectively, or the distances from an upper edge 95*a* of the toner supply route 95 to the lower edges 111*a*, 112*a*, 113*a* and 114*a*, respectively. In other words, the heights from the toner supply route 95 to the lower edges 111*a*, 112*a*, 113*a* and 114*a* are reduced gradually. The toner supply port 115 is formed so as to extend from the upper edge 95*a* to the bottom surface of the toner supply route 95, and a height H5 from the upper edge 95*a* to the bottom surface of the toner supply route 95 is defined as an aperture height.

The respective aperture widths S1, S2, S3 and S4 of these toner supply ports 111 to 114 gradually increase as the toner supply ports 111 to 114 become more distant from the toner inlet 94. The aperture width S5 of the toner supply port 115 is set at a suitable size.

Since the toner supply route 95 is thus provided with the toner supply ports 111 to 115 that are arranged side by side in the direction of toner transportation, the toner T can be dispersed in the direction of toner transportation in the toner supply route 95 and flowed out to the toner tank 91. If the toner supply ports are provided only in the one end portion of the toner supply route 95, the toner T locally flows out into the toner tank 91 through the toner supply ports. Since the respective aperture areas of these toner supply ports 111 to 114 are gradually increased with distance from the toner inlet 94, the toner T can be run at a substantially uniform rate of flow into the toner tank 91 through the toner supply ports 111 to 114. Changing the respective heights of lower edges 111*a* to 114*a* of the toner supply ports 111 to 114 is an effective way of adjusting the rate of flow of the toner. The aperture height of the toner supply port 115 at the other end portion of the toner supply route 95 is set at a maximum size in order to run out all the toner T in the toner supply route 95.

Thus, at that portion which locate near the toner inlet 94 in the toner supply route 95, the toner from the toner cartridge 72 is effected pressure from the conveyor screw 82 of the toner cartridge 72, and the pressure lowers as the toner is transported away from the toner inlet 94. When the respective aperture areas of the individual toner supply ports are equal, the quantity of the toner T which flow out through the toner supply port that is located near the toner inlet 94 is greater, and the quantity of the toner T which flow out through the toner supply port that is distant from the toner inlet 94 is reduced. Therefore, the quantities of those portions of the toner T which flow out through the toner supply ports 111 to 115 from the plane of the aperture areas are gradually increased as increasing gradually the respective aperture areas of the toner supply ports 111 to 114 according to becoming apart from the toner inlet 94. In this manner, the quantities of the toner which flow out through the toner supply ports 111 to 115 are substantially equal by balancing the reduction of the toner pressure and the increase of the respective aperture areas of the toner supply ports 111 to 115. The respective aperture areas of the toner supply ports 111 to 115 are set in consideration of this point.

Thus, the toner T that is transported by means of the toner supply route 95 can be uniformly dispersed covering the entire area in the axial direction of the toner supply route or the entire area in the direction of toner transportation, and fed into the toner tank 91 through the toner supply route 95.

The bottom portion of the lower housing 42 of the unit housing 31 has a sensor 116 for detecting the quantity of the toner in the toner tank 91. The screw 82 set in the toner cartridge 72 is driven in accordance with the toner quantity that is detected by means of the sensor 116. Thus, the toner T is suitably supplied from the toner cartridge 72 to the toner tank 91.

In the toner tank 91, an image developing roller 99 is set extending parallel to the photosensitive drum 62 in a position under the photosensitive drum 62. This image developing roller 99 is exposed through the open portion of the toner tank 91 and touches the photosensitive drum 62 from below. In the toner tank 91, two agitators 97 and 98 are set between the toner supply route 95 and the image developing roller 99. These two agitators 97 and 98 are arranged extending parallel to the toner supply route 95 of the toner tank 91 and the photosensitive drum 62, and rotatably attached to the casing 92. The toner conveyor screw 96, two agitators 97 and 98, and image developing roller 99 are individually rotated by means of a drive mechanism 103 that is attached to the apparatus body 1.

The agitators 97 and 98 transport the toner T to the image developing roller 99 as agitating the toner T. In the toner tank 91, the toner is uniformly dispersed to the lower side of the toner supply route 95 covering the entire area in the axial direction of the toner supply route 95 and accumulated in the toner supply route 95. Thus, the agitators 97 and 98 supply the toner T to the image developing roller 99 as fully agitating the toner T and dispersing it uniformly covering the entire area in the axial direction of the image developing roller 99. The image developing roller 99 supplies the toner T to the photosensitive drum 62, as uniformly dispersing the toner T covering the entire area in its axial direction. Thus, the sufficient quality of the toner image formed on the photosensitive drum 62 can be maintained.

The image developing roller 99 forms the toner image by supplying the toner T to the photosensitive drum 62 and developing a latent image on the photosensitive drum 62.

A toner regulating member 100 is designed to regulate the thickness of the toner by touching the image developing roller 86. A holder 101 is used for attaching the toner regulating member 100 to the toner tank 91.

A window 102 is formed at the junction of the upper housing 41 and the lower housing 42. As a beam of light shoots the photosensitive drum 62 from the exposing device 9 through the window 102, a latent image is formed on the photosensitive drum 62.

The transfer unit 23 is located outside the process unit housing 31 facing the photosensitive drum 62. The transfer unit 23 includes a transfer unit body 121, transferring device 122, corona discharging device 123, and guide roller 124. The transferring device 122, corona discharging device 123, and guide roller 124 are attached to the transfer unit body 121, and constitute a supply path, along which the recording sheets P are passed, with the photosensitive drum 62.

The transfer unit body 121 is attached to the lower housing 42 at the lower end portion of it by means of a fulcrum shaft 125, and is able to rotate around the fulcrum shaft 125 in a direction such that the photosensitive device unit body 31 and the photosensitive drum 62 are covered or uncovered.

The upper end portion of the transfer unit body 121 has a locking member 126, and the upper housing 41 has a pin 127 that is fit to the locking member 126. When the transfer unit body 121 is in its closed position, the locking member 126 is detachably locked to the pin 127, thereby keeping the transfer unit body 121 at its closed position. A torsion coil spring 128 is supported on the fulcrum shaft 125, and urges the transfer unit body 121 to approach the photosensitive device unit body 31.

The transferring device 122 is located facing the photosensitive drum 62, and serves to transfer the toner image on the photosensitive drum 62 to each of the recording sheets P. The transferring device 122, which is the corona-discharge type, transfers the image by charging electric charge to the recording sheet and bringing the recording sheet into contact with the photosensitive drum 62. The corona discharging device 123 serves to peel the recording sheet that is in contact with the photosensitive drum 62 by utilizing corona discharge to supply electric charge to the recording sheet P, and is located on the lower-stream side of the transferring device 122 with respect to the direction of recording sheet transportation. The guide roller 124, which serves to guide the recording sheet P to the transferring device 122, is located on the upper-stream side of the transferring device 122 with respect to the direction of recording sheet transportation.

In this process unit U, the transfer unit body 121 of the transfer unit 23 is located in the closed position, and is held in the closed position as the locking member 126 and the pin 127 are coupled to each other. The recording sheet P is transported from under the process unit U, moves along the supply path, and is transported to the position above the process unit U. While the recording sheet P is transported along the supply path, the toner image on the photosensitive drum 62 is transferred to the recording sheet P by means of the transferring device 122.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An image developing unit comprising a toner cartridge and an image developing device, wherein said toner cartridge stores a toner and has a toner outlet through which the toner flows out, wherein said image developing device includes a toner tank having a toner inlet capable of receiving the toner flowed out from the toner outlet of said toner cartridge and a toner supply route extending away from the toner inlet and capable of receiving the toner flowed into through the toner inlet, wherein a conveyor is provided in said toner tank for transporting away from said toner inlet the toner received by said toner supply route, and an image developing roller is set in said toner tank, wherein said toner supply route has a plurality of toner supply ports arranged away from said toner inlet so that the toner in said toner supply route flows out through the toner supply ports into said toner tank, and respective aperture areas of said plurality of toner supply ports gradually increase with distance from said toner inlet, and wherein said plurality of toner supply ports individually have edge portions capable of stemming the toner in said toner supply ports, and respective heights of said edge portions of the plurality of toner supply ports gradually decrease with distance from said toner inlet.

2. An image developing unit according to claim 1, wherein respective widths of said plurality of toner supply ports gradually increase with distance from said toner inlet.

3. An image developing unit according to claim 1, wherein said conveyor comprises a screw located extending along said toner supply route.

4. An image developing unit according to claim 1, wherein said image developing roller is set extending parallel to said toner supply route.

5. An image developing unit according to claim 1, wherein an agitator is provided in said toner tank between said toner supply route and said image developing roller, and said agitator is capable of agitating the toner and is set extending parallel to said image developing roller.

6. An image developing unit according to claim 1, wherein a sensor is arranged in close proximity to said toner tank for detecting a quantity of the toner in said toner tank, and an additional conveyor is provided in said toner cartridge, said additional conveyor being driven in accordance with the toner quantity detected by said sensor.

7. An image developing unit comprising a toner cartridge and an image developing device, wherein said toner cartridge stores a toner and has a toner outlet through which the toner flows out, wherein said image developing device includes a toner tank having a toner inlet capable of receiving the toner flowed out from the toner outlet of said toner cartridge and.a toner supply route extending away from the toner inlet and capable of receiving the toner flowed into through the toner inlet, wherein a conveyor is provided in said toner tank for transporting away from said toner inlet the toner received by said toner supply route, and an image developing roller is set in said toner tank, wherein said toner supply route has a plurality of toner supply ports arranged away from said toner inlet so that the toner in said toner supply route flows out through the toner supply ports into said toner tank, and respective aperture areas of said plurality of toner supply ports gradually increase with distance from said toner inlet, and wherein respective widths of said plurality of toner supply ports gradually increase with distance from said toner inlet.

8. An image forming apparatus comprising:

an apparatus body;

a photosensitive device; and an image developing unit including a toner cartridge and an image developing device, wherein said toner cartridge stores a toner and has a toner outlet through which the toner flows out, wherein said image developing device includes a toner tank having a toner inlet capable of receiving the toner flowed out from the toner outlet of said toner cartridge and a toner supply route extending away from the toner inlet and capable of receiving the toner flowed into through the toner inlet, wherein a conveyor is provided in said toner tank for transporting away from said toner inlet the toner received by said toner supply route, and an image developing roller is set in said toner tank, wherein said toner supply route has a plurality of toner supply ports arranged away from said toner inlet so that the toner in said toner supply route flows out through the toner supply ports into said toner tank, and respective aperture areas of said plurality of toner supply ports gradually increase with distance from said toner inlet, and wherein said plurality of toner supply ports individually have edge portions capable of stemming the toner in said toner supply ports, and respective heights of said edge portions of the plurality of toner supply ports gradually decrease with distance from said toner inlet.

* * * * *